US005385655A

United States Patent [19]

Brent et al.

[11] Patent Number: 5,385,655

[45] Date of Patent: Jan. 31, 1995

[54] TREATMENT OF METAL PARTS TO PROVIDE RUST-INHIBITING COATINGS

[75] Inventors: Randall J. Brent, North Royalton; David A. Blaha, Parma, both of Ohio

[73] Assignee: Man-Gill Chemical Company, Cleveland, Ohio

[21] Appl. No.: 156,308

[22] Filed: Nov. 23, 1993

Related U.S. Application Data

[63] Continuation of Ser. No. 969,128, Oct. 30, 1992, abandoned.

[51] Int. Cl.[6] ..... C25D 13/12

[52] U.S. Cl. ..... 204/181.1; 204/181.3; 427/409; 427/417; 148/246; 148/257

[58] Field of Search ..... 204/181.1, 181.3; 427/409, 417; 148/246, 257

[56] References Cited

U.S. PATENT DOCUMENTS

| | | | |
|---|---|---|---|
| Re. 27,896 | 1/1974 | Rausch et al. | 204/181 |
| 3,454,483 | 7/1969 | Freeman | 204/181 |
| 3,620,949 | 11/1971 | Caulfield et al. | 204/181 |
| 3,864,230 | 2/1975 | Springer et al. | 204/181 |
| 4,007,102 | 2/1977 | Springer et al. | 204/181 |
| 4,165,242 | 8/1979 | Kelly et al. | 204/181.1 |
| 4,175,018 | 11/1979 | Gacesa | 204/181.1 |
| 4,375,498 | 3/1983 | Le Minez et al. | 204/181.1 |
| 4,650,526 | 3/1987 | Claffey et al. | 148/259 |

*Primary Examiner*—John Niebling
*Assistant Examiner*—Kishor Mayekar
*Attorney, Agent, or Firm*—Renner, Otto, Boisselle & Sklar

[57] ABSTRACT

The invention describes a method of producing an adherent and corrosion-inhibiting multi-layer coating on metal parts comprising the steps of (A) phosphating the metal parts with an aqueous metal phosphating solution;

(B) electrophoretically depositing a film of a siccative organic coating composition on the phosphated metal parts;

(C) applying a second film of a composition comprising at least one film-forming organic resin component as a seal coat;

(D) curing the coating on the metal parts; and optionally (E) applying a corrosion-inhibiting film as a top seal coat.

27 Claims, No Drawings

TREATMENT OF METAL PARTS TO PROVIDE RUST-INHIBITING COATINGS

This is a continuation of co-pending application Ser. No. 07/969,128 filed on Oct. 30, 1992 now abandoned.

TECHNICAL FIELD

This invention relates to an improved metal treatment process and to metal surfaces thus treated. More particularly, the invention relates to the coating of metal substrates, particularly metal articles such as nuts, bolts, etc., to improve the corrosion resistance of such parts.

BACKGROUND OF THE INVENTION

Siccative organic coating compositions have been applied to metal surfaces such as by spraying, dipping, rolling, centrifuged dip-spinning, etc. In recent years, various water-soluble resin-based paints and lacquers have been developed, and progress has been made toward the application of such coating systems by electrophoresis. The electrophoretic application of paint and lacquer involves the phenomena of electro-osmosis and electrolysis, as well as electro-phoresis. In this method, an electric current is passed through the paint or lacquer solution while the article to be painted is made an electrode, usually the anode, in the paint or lacquer.

The electrodeposition of water-based coatings has been employed to process metal parts including small stamped parts such as nuts, bolts, and fasteners. The use of electrodeposition of siccative organic coatings on small parts has advantages over other methods of coating. For example, the process deposits a film of uniform thickness on essentially any conductive surface, even those which have sharp points and edges. The electrocoated film when applied, is relatively water-free and, thus, will not run or drip when taken out of the bath. The use of water-base coating compositions also is advantageous since they contain little or no organic solvents or other volatile organic compounds. Accordingly, such aqueous systems and processes do not require special precautions or equipment for handling any harmful volatile materials, and such aqueous systems and processes do not contribute to the problem of volatile organic emissions and air pollution.

It also is well known in the metal-finishing art that metal surfaces such as aluminum, ferrous and zinc surfaces may be provided with an inorganic phosphate coating by contacting the surfaces with an aqueous phosphating solution. The phosphate coating protects the metal surface to a limited extent against corrosion and serves primarily as an excellent base for the later application of a siccative organic coating composition such as paint, lacquer, varnish, primer, synthetic resin, enamel, and the like. Procedures also have been described in the art for improving the rust-resistance of metal articles by the application of a film of paint over phosphated surfaces. Although the application of a siccative coating over a phosphated metal surface improves the corrosion resistance properties of the metal, there continues to be a need to improve the corrosion resistance of electrophoretically painted metal surfaces.

Procedures for improving the rust resistance of metal articles by application of a film of paint over a phosphated surface have been described in a number of patents such as U.S. Pat. Nos. 3,454,483; 3,620,949; 3,864,230; 4,007,102; 4,165,242 and Re. 27,896. As noted in U.S. Pat. No. Re. 27,896, the electrophoretic application of paint and lacquer over a phosphated metal surface is not a complete solution to the rust problem. It has been found that when paint is electrodeposited on phosphate coated ferrous metal surfaces, the resulting paint films have often been found to contain numerous small depressions or pin holes. Such films generally provide only a slight corrosion protective action, probably due to the presence of a lower film thickness in the depressions. In an attempt to overcome this problem, paints and lacquers have been used containing synthetic resin components which form films which during a subsequent baking will soften so that the surface blends smoothly and the depressions and pin holes are filled with resin. One difficulty with this technique, however, is that there often is a withdrawal of the paint film from the edges of the workpiece being treated so that these portions are then subjected to additional corrosion attacks. In U.S. Pat. No. Re. 27,896, a solution to this problem is suggested which involves the incorporation of cupric ions into the zinc phosphate coating applied to the article prior to painting. In U.S. Pat. No. 3,454,483, an improvement in the corrosion resistance of electrophoretically painted metal surfaces is suggested when the phosphate coating used as a primer for the paint contains fluoride ions.

U.S. Pat. No. 4,165,242 describes a method for treating metal parts either singly or in bulk barrel processing to provide durable and rust-inhibiting coatings which comprises the steps of (a) treating the metal parts with an aqueous phosphating solution to deposit a phosphate coating thereon, (b) electrophoretically depositing a siccative organic coating on the phosphate coated metal pans, and (c) treating the siccative organic coated part with an oil to deposit a corrosion-inhibiting top coat.

SUMMARY OF THE INVENTION

A method of producing an adherent and corrosion-inhibiting multi-layer coating on metal pans is described which comprises the steps of (A) phosphating the metal parts with an aqueous metal phosphating solution;

(B) electrophoretically depositing a film of siccative organic coating composition on the phosphated metal parts;

(C) applying a second film of a coating composition comprising at least one film-forming organic resin component as a seal coat;

(D) curing the coating on the metal parts; and optionally (E) applying a corrosion-inhibiting film as a top seal coat.

DESCRIPTION OF THE PREFERRED EMBODIMENTS

The improved process of this invention can be utilized to improve the corrosion-inhibiting properties of metal surfaces such as aluminum, iron, steel and zinc surfaces and is useful particularly for bulk handling and treating small metal parts such as nuts, bolts and screws and subassemblies which otherwise are particularly difficult to rust-proof because of the difficulty of coating the more inaccessible areas of these parts such as the grooves between the threads, and the tendency of treated parts to nest together during treatment and curing.

Phosphate Coating

The first essential step in the process of the invention is the treatment of the metal parts with an aqueous phosphating solution to deposit a phosphate coating thereon. The use of zinc, lead, iron and manganese phosphate solutions is preferred. It is well known in the metal finishing art to provide metal surfaces with an inorganic phosphate coating by contacting them with aqueous phosphating solutions. These aqueous solutions contain the phosphate ion and, optionally, certain auxiliary ions including metallic ions such as sodium, zinc, cadmium, iron, copper, lead, nickel, cobalt, calcium, magnesium, strontium, barium, and antimony ions and non-metallic ions such as ammonium, chloride, bromide, nitrite, and chlorate ions. These auxiliary ions modify the character of the phosphate coating and adapt the solutions for a wide variety of applications.

The preparation and use of aqueous phosphating solutions is well known in the metal finishing art as shown by U.S. Pat. Nos. 1,206,075; 1,485,025; 2,001,754; 2,859,145; 3,090,709; 3,104,177; 3,307,979; and 3,458,364. The disclosures of these patents regarding inorganic phosphating solutions and the procedures for using such solution are hereby incorporated by reference.

The inorganic phosphate coatings may be any of those known in the art including zinc phosphate coatings, iron phosphate coatings, lead phosphate coatings, cadmium phosphate coatings, and mixed calcium-zinc phosphate coatings. The iron phosphate coatings can be applied over iron, steel or alloys thereof, and the zinc phosphate coatings generally are applied over iron steel, zinc, aluminum, or alloys thereof.

In view of the extensive commercial development of the phosphating art and the many journal publications and patents describing the preparation and application of phosphating solutions, it is believed unnecessary to lengthen this specification unduly by a detailed recitation of the many ways in which the application of metal phosphate coatings can be accomplished. It should be sufficient to indicate that any of the commonly used phosphating techniques such as spraying, brushing, dipping, roller-coating, or flow-coating may be employed, and that the temperature of the aqueous phosphating solution may vary within wide limits such as, for example, from room temperature to about 100° C. Generally, best results are obtained when the aqueous phosphating solution is used at a temperature within the range of from about 65° C. to about 100° C. If desired, however, the phosphating baths may be used at higher temperatures when employing super atmospheric pressures.

In the ordinary practice of phosphating a metal surface, the surface generally is cleaned initially by physical and/or chemical means to remove any grease, dirt, or oxides, and then it is phosphated in the manner described above. Cleaning solutions are known in the art and generally are aqueous solutions containing sodium hydroxide, sodium carbonate, an alkali metal silicate, alkali metal metaborate, water softeners, phosphates, and surface active agents. Oxide removal is usually accomplished with mineral acid pickles such as sulfuric acid, hydrochloric acid, and phosphoric acid. This removal could be considered as supplemental cleaning.

The phosphating operation usually is carried out until the desired weight of the phosphate coating is formed on the metallic surface. In the phosphating art, "heavy phosphate" coatings are generally deposited in an amount in excess of 1000 or 1500 mg/ft$^2$ of surface. Lesser amounts of coatings are referred to as "light phosphate" coatings. The time required to form the coating will vary according to the temperature, the type of phosphating solution employed, the particular technique of applying the phosphating solution, and the coating weight desired. In most instances, however, the time required to produce the phosphate coating of the weight preferred for the purpose of the first step of the present invention will be within the range of from about 1 second to as long as 15 to 40 minutes depending on the type of phosphating solution. When high total acid aqueous phosphating solutions are used, the immersion time is from about a few seconds to one to two minutes.

After the desired contact between the surfaces to be treated and the phosphate solution has been effected for the desired period of time, the phosphated article may be rinsed with water to remove any of the acidic coating solution which may remain on the surface. Preferably, a hot water rinse is used with water temperatures within a range of from about 50° C. to about 100° C. As with the application of the phosphate coating solution, various contacting techniques may be used, with rinsing by dipping or spraying being preferred.

In addition to or in place of the water rinse, the phosphated article can be contacted with an under-paint corrosion inhibitor which may be an organic composition or aqueous solution containing an organic or inorganic composition which seals the phosphate coating prior to the electrodeposition of the siccative organic coatings. Examples of useful organic compositions include amides and esters such as derived from dibasic acids neutralized with an amine or hydroxyamine. Examples of dibasic acids include, sebacic and glutaric acid, malonic acid, suberic acid, succinic acid, dodecanedioic acid, etc. Examples of amines and hydroxyamines include methylamine, ethylamine, monoethanolamine, diethanolamine, triethanolamine, etc. Examples of aqueous solutions of inorganic compositions include aqueous solutions of alkali metal nitrites, alkali metal fluozirconates, ammonium phosphates, etc. Specific examples include aqueous solutions containing sodium nitrite, diammonium phosphate, sodium fluorozirconate, potassium fluorozirconate, mixtures of diammonium phosphate and sodium chlorate, etc.

In another embodiment, the phosphated articles can be rinsed with a hot dilute aqueous solution of chromic acid containing trivalent or hexavalent chromium calculated as $CrO_3$, typically in an amount within the range of from about 0.01 to about 1% by weight of the solution. The chromic acid rinse appears to "seal" the phosphate coating and improve its utility as a base for the application of the siccative organic coating.

Various water-soluble or water-dispersible sources of hexavalent chromium may be used in formulating the rinsing solution, provided the anions and the cations introduced with the hexavalent chromium do not have a detrimental effect on either the solution itself, the coated surfaces treated or the subsequently applied paint composition. Exemplary of hexavalent chromium materials which may be used are chromic acid, the alkali metal and ammonium chromates, the alkali metal and ammonium dichromates, the heavy metal chromates and dichromates such as those of zinc, calcium, chromium, ferric ion, magnesium, and aluminum. Chromic acidphosphoric acid mixtures, mixtures of hexavalent and trivalent chromium, as well as completely trivalent chromium mixtures, also can be utilized. A typical chrome rinse solution can be prepared, for example, by dissolving 38.4 grams of chromic acid and 12.9 grams of hydrated line in 48.7 grams of water. The working bath is prepared by adding approximately 1 pint of the solution above to 100 gallons of water.

The chromium rinse solution can be applied to the coated metal surfaces using various techniques including immersion, flooding, spraying, etc. Generally, it is preferred that the aqueous chromium containing rinse solution is maintained at an elevated temperature while it is contacted with the phosphated coated metal surface. Temperatures in the range of from about 30° C. to 100° C. and contact times of up to about 30 seconds or 2 minutes are typical. Following the application of the chromium containing rinse solutions, the treated metal surfaces preferably may again be rinsed with water so as to remove any of the acidic rinse solution which may remain on the surface.

First Film; Electrodeposition

After the metal article has been phosphated in accordance with the procedure described above and optionally given a chrome rinse, a protective film of a siccative organic coating composition is applied by the electrophoretic process of painting metal surfaces.

In the electrophoretic process, the metal article to be coated is placed in an electrolytic solution which contains water-emulsified colloidal paint particles. The phosphate coated metal surface to be painted may be either the anode or the cathode, depending on the characteristics of the paint which is used.

The electrophoretic application of the paint may be carried out in various ways as are known to those skilled in the art. Typically an electric charge is passed through both the metal surface and the water-based paint by placing a positive charge on the metal surface which acts as an electrode, and a negative charge on the second electrode, generally the container of the paint. An alternative method would be to charge the container or parts with a positive charge, which acts as an electrode transmitting its charge to the parts. In this electric field, the colloidal particles of the paint which are in suspension move either toward the negative or positive electrode depending on the charge carried by the dispersed particles. In the present situation, namely, the metal surface having a positive charge, negative paint particles are attracted to the metal surface of the parts. Upon contact with the metal surface of the parts, the colloidal particles lose their electrical charge, thereby breaking the emulsion and depositing as a coating on the electrode. The metal article or container of metal articles is then removed from the solution, rinsed, and baked in an oven to cure the deposited coating.

The electrical potential applied in the process of electrophoresis is determined by the desired thickness of the coating, the conductivity and the composition of the coating bath, and the time allotted for the formation of the coating. Voltages of from about 50 to 1000 volts have proven satisfactory at a current density of from about 0.1 to about 7 amperes per square foot. Normally, the coating solution is at substantially room temperature, but elevated temperatures, for example, from 20° C. to 40° C. and even higher, may be used if desired. The deposition process requires about 10 seconds to about 10 minutes.

The compositions which are utilized in the electrophoretic coating process of the invention generally comprise water emulsions, dispersions, or solutions based on water-dispersible or emulsifiable synthetic resins such as alkyd resins, acrylic polymers, melamine resins, epoxy resins, phenolic resins, polyester resins, polybutadiene resins, cyclized olefin resins, polyvinyl alcohol resins and natural resins. These aqueous resin compositions generally will have a pH of about 9 for anodic application and about pH 5 for cathodic paints, and the solvent used is either water or an aqueous alcoholic mixture. The siccative organic coating compositions may be either paints or lacquers, i.e., they may be either pigmented or unpigmented. The siccative organic coating compositions generally contain highly polar resins and principally thermosetting resins.

Any water-dispersible or emulsifiable film-forming resin can be utilized in the siccative organic coating compositions used in the present invention provided that the aqueous compositions containing such resins deposit an adherent coating on the phosphated metal surface. The resins which have been found to be particularly useful in the aqueous compositions of the present invention are thermosetting resins such as urethanes, amino resins, acrylic resins, alkyd resins, epoxy resins, phenolic resins, cyclized olefin rubbers, halogenated polyolefins, halo-sulfonated polyolefins, polybutadiene rubbers, natural resins, and mixtures thereof. Particularly useful are the epoxy resins and mixtures of epoxy resins and amino resins, (e.g., melamine resins). The amount of resin included in the aqueous compositions used in the process of this invention may range from about 3 to about 40% by weight. In one preferred embodies the aqueous compositions contain from about 5 to about 25% by weight of resin.

Thermosetting epoxy resins are particularly useful in the present invention as component (A) and they include any of a number of well-known organic resins which are characterized by the presence therein of the epoxide group

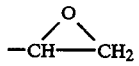

A wide variety of such resins are available commercially. Such resins have either a mixed aliphatic-aromatic or an exclusively non-benzeneoid (i.e., aliphatic or cycloaliphatic) molecular structure.

The mixed aliphatic-aromatic epoxy resins which are useful with the present invention are prepared by the well-known reaction of a bis(hydroxy-aromatic) alkane or a tetrakis-(hydroxyaromatic)-alkane with a halogen-substituted aliphatic epoxide in the presence of a base such as, e.g., sodium hydroxide or potassium hydroxide. Under these conditions, hydrogen halide is first eliminated and the aliphatic epoxide group is coupled to the aromatic nucleus via an ether linkage. Then the epoxide groups condense with the hydroxyl groups to form polymeric molecules which vary in size according to the relative proportions of reactants and the reaction time.

In lieu of the epichlorohydrin, one can use halogen-substituted aliphatic epoxides containing about 4 or more carbon atoms, generally about 4 to about 20 carbon atoms. In general, it is preferred to use a chlorine-substituted terminal alkylene oxide (terminal denoting that the epoxide group is on the end of the alkyl chain) and a particular preference is expressed for epichlorohydrin by reason of its commercial availability and excellence in forming epoxy resins useful for the purpose of this invention.

If desired, the halogen-substituted aliphatic epoxide may also contain substituents such as, e.g., hydroxy keto, nitro, nitroso, ether, sulfide, carboalkoxy, etc.

Similarly, in lieu of the 2,2-bis-(p-hydroxyphenyl)-propane, one can use bis-(hydroxyaromatic) alkanes containing about 16 or more carbon atoms, generally about 16 to about 30 carbon atoms such as, e.g., 2,2-bis-(1-hydroxy-4-naphthyl)-propane; 2,2-bis(o-hydroxyphenyl)propane; 2,2-bis-(p-hydroxyphenyl) butane, 3,3-bis-(p-hydroxyphenyl)hexane; 2-(p-hydroxyphenyl)-4-(1-hydroxy-4-naphthyl)octane, 5-5-bis-(p-hydroxy-o-methylphenyl)-decane, bis-(p-hydroxyphenyl) methane, 2,2-bis-(p-hydroxy-o-isopropylphenyl)propane,2,2-bis-(o,p-dihydroxyphenyl)propane, 2-(p-hydroxyphenyl)-5-(o-hydroxyphenyl)hexadecane, and the like. If desired, the bis-(hydroxyaromatic)alkane may contain substituents such as, e.g., halogen, nitro, nitroso, ether, sulfide, carboalkoxy, etc. In general, it is preferred to use a bis-(p-hydroxyphenyl)alkane since compounds of this type are readily available from the well-known condensation of phenols with aliphatic ketones or aldehydes in the presence of a dehydrating agent such as sulfuric acid. Particularly preferred is 2,2-bis-(p-hydroxyphenyl)propane, which is available commercially as "Bisphenol A".

Epoxy resins of the type described above are available from a wide variety of commercial sources. One group is known by the general trade designation "Epon" resins and are available from Shell Chemical Co. For example, "Epon 820" is an epoxy resin having an average molecular weight of about 380 and is prepared from 2,2-bis-(p-hydroxyphenyl)propane and epichlorohydrin. Similarly, "Epon 1031 ∞ is an epoxy resin having an average molecular weight of about 616 and is prepared from epichlorohydrin and symmetrical tetrakis-(p-hydroxyphenyl)ethane. "Epon 828" has a molecular weight of 350–400 and an epoxide equivalent of about 175–210.

Another group of commercially available epoxy resins are identified under the general trade designation EPI-REZ (Celanese Resins, a Division of Celanese Coatings Company). For example, EPI-REZ 510 and EPI-REZ 509 are commercial grades of the diglycidyl ether of Bisphenol A differing slightly in viscosity and epoxide equivalent.

Another group of epoxy resins are available from Furane Plastics Inc., Los Angeles, Calif. under the general trade designations EPIBOND and EPOCAST. For example, EPIBOND 100A is a one component epoxy resin powder available from Furane which is curable to a hard resin in the absence of any hardener.

Liquid forms of epoxy resin are also useful. These liquid forms normally comprise very viscous liquids requiting some degree of heating to permit withdrawal from storage containers. Certain "D.E.R." resins obtainable from Dow Chemical Company and "EPOTUF" liquid epoxy resins obtainable from Reichhold Chemicals Inc. are examples of such resins preferred for employment in accordance with the invention. An example of an "Epotuf" liquid epoxy resin in the undiluted medium high viscosity #37-140 having an epoxide equivalent weight of 180–195, a viscosity (ASTM D445) of 11,000–14,000 cps at 25° C., and a Gardner Color Maximum of 3. This is a standard general purpose epoxy resin.

In some embodiments of the invention the epoxy resins may be "solubilized" by neutralization with a basic compound such as an organic amine. Examples of amines include amines and hydroxyamines including diethylamine, triethylamine, triethanolamine, dimethylethanolamine, etc. The epoxy resins may also be "solubilized" by neutralization with an acid. An example of a commercially available useful acid neutralized water reducible epoxy resin is resin K-5276 available from The Glidden Company.

The amino resins (sometimes referred to as aminoplast resins or polyalkylene amides) useful in the coating compositions are nitrogen-rich polymers containing nitrogen in the amino form, —$NH_2$. The starting amino-bearing material is usually reacted with an aldehyde (e.g., formaldehyde) to form a reactive monomer, which is then polymerized to a thermosetting resin. Examples of amino-bearing materials include urea, melamine, copolymers of both with formaldehyde, thiourea, aniline, dicyanodiamide, toluene sulfonamide, benzoguanamine, ethylene urea and acrylamide. Preferred amino resins are the melamine-formaldehyde and urea-formaldehyde resins.

Condensation products of other amines and amides can also be employed, for example, aldehyde condensates of triazines, diazines, triazoles, guanadines, guanamines and alkyl- and aryl-substituted derivatives of such compounds including alkyl- and aryl-substituted ureas and alkyl- and aryl-substituted melamines. Some examples of such compounds are N,N'-dimethylurea, benzourea, dicyandiamide, 2-chloro-4,6-diamino- 1,3,5-triazine and 3,5-diaminotriazole. Other examples of melamine and urea-based cross-linking resins include alkylated melamine resins including methylated melamine-formaldehyde resins such as hexamethoxymethyl melamine, alkoxymethyl melamines and ureas in which the alkoxy groups have 1-4 carbon atoms such as methoxy, ethoxy, propoxy, or butoxymethyl melamines and dialkoxymethyl ureas; alkylol melamines and ureas such as hexamethylol melamine and dimethylol urea. The aminoplast cross-linking resins are particularly useful when another thermosetting resin in the aqueous composition is an alkyd resin, a polyester resin, an epoxy resin or an acrylic resin.

Some particularly useful commercially available aminoplast resins are amino resins sold by American Cyanamid under the general trade designation CYMEL. In particular, CYMEL 301, CYMEL 303 and CYMEL 1156, all of which are alkylated melamine-formaldehyde cross-linking resins, are useful herein. Additional melamine-formaldehyde resins available from American Cyanamid include CYMEL 350, 370, 373, 380, 1116, 1130 and 1158. Benzoguanamines are available from American Cyanamid as CYMEL 1123, 1125 and 1134. Partially alkylated melamine resins from American Cyanamid include CYMEL 235, 243, 245, 248, 255, 270 and 280.

In one embodiment, the aminoplast cross-linking resins are useful in small amounts to cross-link other thermosetting resins such as the water-reducible alkyd resins, water-reducible polyester resins, water-reducible acrylic resins. For example, combinations of epoxy resins and cross-linking amine resins provides improved properties to the coatings.

The polyurethane resins useful in the invention are those formed by reacting an organic diisocyanate with an active hydrogen-containing material such as polyalkylene ether glycols and hydroxy-terminated polyesters to form isocyanate-terminated polyurethane prepolymers which can be cross-linked or cured with known agents such as compounds having at least two amino nitrogen atoms each having at least one reactive hydrogen atom. Alternatively, the active hydrogen compound, organic diisocyanate and chain extender can be reacted in one shot to form the desired polymer.

In the preparation of polyester-urethane resins, there preferably are used hydroxy-terminated polyesters prepared by polycondensation of an aliphatic dicarboxylic acid and a molar excess of an aliphatic glycol, and those prepared by ring-opening polymerization of a cyclic ester of the presence of a difunctional compound as an initiator. The polyesters obtainable by polycondensation of an aliphatic dicarboxylic acid and an aliphatic glycol are exemplified by those obtained by reaction between adipic acid, sebacic acid, maleic acid and other dicarboxylic acids with ethylene-glycol, 1,2-propylene glycol, 1,4-butylene glycol, 1,3-butylene glycol, etc. Examples of the polyesters prepared by polymerization of cyclic esters are those prepared by epsilon-caprolactone, delta-methyl-epsilon-caprolactone and beta-propiolactone in the presence of an initiator such as, for example, 1,4-butylene glycol, ethylene glycol or diethylene glycol.

The polyalkylene ether urethanes are those prepared by reacting the isocyanates with polymeric polyhydroxy compounds which included polyether polyols such as polyalkylene ether glycols, polyalkylene arylene ether-thioether glycols and polyalkylene ether triols. The polyalkylene ether glycols and triols are preferred and these include glycols having the formula $HO(RO)_nH$ wherein R is an alkylene radical which need not necessarily be the same in each instance, and n is an integer. Representative glycols include polyethylene ether glycol, polypropylene ether glycol and polytetramethylene ether glycol. Representative polyalkylene ether triols are made by reacting one or more alkylene oxides with one or more low molecular weight aliphatic triols. The alkylene oxides most commonly used have molecular weights between about 44 and 250 and these include ethylene oxide, propylene oxides, butylene oxides, 1,2-epoxybutane and 2,3-epoxybutane. The ethylene, propylene and butylene oxides are preferred. The aliphatic triols most commonly used have molecular weights between about 92 and 250. Examples include glycerol, 1,2,6-hexane triol and 1,1,1-trimethylol propane.

Representative examples of the polyalkylene ether triols include: polypropylene ether triol (molecular weight 700) made by reacting 608 parts of 1,2-propylene oxide with 92 parts of glycerin; and polypropylene ether triol (molecular weight 6000) made by reacting 5866 parts of 1,2-propylene oxide with 132 parts of 1,2,6-hexane triol.

Other active hydrogen-containing compound which can be reacted with polyisocyanates to form urethanes useful in the coating compositions of the invention are long-chain polymers containing at least two groups having at least one active hydrogen atom as determined by the Zerewitinoff method. Examples of such compounds include in addition to the polyesters and polymeric polyhydroxy compounds described above, polyamides, polyepoxides, reaction products of phenols and alkylene oxides, formaldehyde resins, hydrogenation products of olefin-carbon monoxide copolymers and polyepihalohydrins.

The acrylic resins are obtained by polymerizing a suitable combination of a functional group-containing monomer and another copolymerizable monomer in an ordinary manner. The polymerization temperature is ordinarily between about 60° C. and about 100° C., and polymerization time is usually within a range of about 3 to about 10 hours. Examples of the functional group-containing monomers include hydroxyl group-containing monomers such as beta-hydroxyethyethyl acrylate, betahydroxypropyl acrylate, beta-hydroxyethyl methacrylate, beta-hydroxypropyl methacrylate, N-methylol acrylamide and N-methylol methacrylamide; carboxyl group-containing monomers such as acrylic acid, methacrylic acid, itaconic acid, maleic acid, fumaric acid, as well as monoesters of maleic acid and fumaric acid with monoalcohols; alkoxyl group-containing monomers such as N-butoxy-methylmethacrylamide and N-butoxymethylacrylamide; and epoxy group-containing monomers such as glycidyl methacrylate, glycidyl acrylate and allyl glycidyl ether. These monomers may be used either alone or in the form of a combination of two or more of them. The functional group-containing monomer is used in an amount of about 5 to about 40% by weight of total monomers. Examples of the monomers copolymerized with these functional group-containing monomers include olefinically unsaturated monomers such as ethylene propylene and isobutylene; aromatic monomers such as styrene, vinyltoluene and alphamethylstyrene; ester of methacrylic acid and alcohols of 1 to about 18 carbon atoms such as methylmethacrylate, ethylmethacrylate, propylmethacrylate, n-butylmethacrylate, isobutylmethacrylate, cyclohexylmethacrylate, 2-ethylhexylmethacrylate and laurylmethacrylate; vinyl esters of carboxylic acid of about 1 to about 11 carbon atoms such as vinyl acetate, vinyl propionate and vinyl 2-ethylhexylic acid; as well as vinyl chloride, acrylonitrile and methacrylonitrile. They may be used either alone or in the form of a mixture of two or more of them. Commercial examples of useful acrylic resins include Carboset CR-785, a styrene-acrylic emulsion from B. F. Goodrich; Resin XC-4005, a water-reducible acrylic from American Cyanamid; etc.

The alkyd resins are obtained by reacting a dihydric or polyhydric alcohol and a polybasic acid or anhydride in the presence of a drying oil using known techniques. Examples of the dihydric or polyhydric alcohols include glycerol, pentaerythritol, sorbitol and diethylene glycol. Examples of the polybasic acids or anhydrides include phthalic acid, isophthalic acid, maleic anhydride, fumaric anhydride, non-conjugated linoleic acid, oleic acid, adipic acid, azelaic acid, sebacic acid, tetrachlorophthalic anhydride, and chlorendic anhydride. Examples of the drying oils include soybean oil, linseed oil, dehydrated castor oil, non-oxidizing castor and coconut oils, tung oil, fish oil, sunflower oil, walnut oil, safflower seed oil and tall oil. These alkyd resins may be produced, for example, by direct fusion of glycerol, phthalic anhydride and drying oil at a temperature in the range of from about 210° C. to about 235° C. solvents are then added to adjust the solids content. The amount of drying oil varies depending on the intended use. With respect to the high solids compositions of the invention, the level of drying oil is preferably minimized.

The phenolic resins are any of the several types of synthetic thermosetting resins made by reacting a phenol, cresols, xylenols, p-t-butyl phenol p-phenyl phenol, bis-phenols and resorcinol. Examples of the aldehydes include formaldehyde, acetaldehyde and furfural. Phenol-formaldehyde resins are a preferred class of such phenolic resins.

Cyclized olefin rubbers found to be useful in the coating compositions of the present invention include the cyclized rubbers obtained by isomerization of linear polyolefins such as polyisoprene into ring structures. More particularly, the cyclized rubber can be made by condensing rubber with metallic or metalloid halide catalysts such as stannic chloride, titanium tetrachloride, ferric chloride and antimony pentachloride in a suitable solvent. Upon treatment of the resultant product with acetone or alcohol, the cyclized rubber is formed and recovered. Other procedures for preparing cyclized rubber are described in U.S. Pat. Nos 1,846,247; 1,853,334. The solvent may be an aromatic solvent such as toluene, xylene, benzene, and high-flash aromatic naphthas.

A commercially available cyclized olefin rubber found to be useful in the coating compositions of the present invention, either alone or in combination with other olefin polymers such as chlorinated polyolefins is a cyclized rubber derived from synthetic rubber by isomerization of the linear polyisoprene. This material is available from Daniel Products Company, Jersey City, N.J., under the general trade designation Synotex 800.

The water-dispersible or emulsifiable film-forming resin utilized in the aqueous compositions of the present invention also may be halogenated polyolefins such as chlorinated polyethylene, chlorinated polypropylene, mixtures of chlorinated polyethylene and chlorinated polyolefin, etc. Chlorosulfonated polyolefins such as chlorosulfonated polyethylene and chlorosulfonated polypropylene also may be utilized.

Examples of chlorinated polyolefins which are useful in the aqueous compositions of the present invention include the chlorinated polyolefins available from Eastman Chemical Products, Inc. under the designations CP-343-1 and CP-343-3 which are chlorinated polyolefins in various concentrations of xylene including solutions containing 40% and 50% of the chlorinated polyolefins in xylene. Commercially available chlorosulfonated polyethylenes are available from the DuPont Company under the general trade designation Hypalon Synthetic Rubber.

Chlorosulfonated olefins such as chlorosulfonated polyethylene are derived from the reaction of a mixture of chlorine and sulfur dioxide on any of the various polyethylenes. The product of this reaction is a chemically modified form of the original polyethylene, and the product may contain from 20% to about 40% chlorine and about 1% to 2% sulfur present mostly as secondary sulfonyl chloride groups ($SRR'CHSO_2Cl$). The sulfonyl chloride groups are available as cross-linking or curing sites.

A number of chlorine containing vinyl-acrylic emulsions are available from ICI Resins which include emulsions containing three polymers, namely, polyvinylidene chloride/polyvinyl chloride/polyacrylic acid under the general trade designation "Haloflex". For example, Haloflex HA-202 is such a mixture containing 60% solids and 64% chlorine, and Haloflex EP-252 contains 55% solids and 38% chlorine.

Mixtures of one or more of the above-described resins may be used with advantage. For example, mixtures of epoxy resins and amino resins are useful, and the amino resin serves as a cross-linking resin providing unique and desirable properties.

The resins which are utilized in the aqueous compositions of the present invention may be solubilized by partially or completely neutralizing the resin with a base such as an amine or potassium hydroxide or with acids. Amines and hydroxy-substituted amines such as triethylamine and triethanolamine are examples of amines which have been utilized to neutralize resins for use in aqueous coating compositions which are to be deposited by electrophoretic techniques. With cathodic electrocoating, the resin generally is a basic polymer resin which has been neutralized with a soluble acid. During electrocoating, the amine takes on a hydrogen ion and is driven to the cathode where the hydrogen is liberated. The amine or other neutralizing agent is not completely deposited in the coating and will stay in the bath except for small amounts which are lost through dragout to maintain a relatively constant level of amine, the bath may be treated in an ultra filter or other suitable device to remove amines and other low molecular weight contaminants from the working bath. Coupling agents which assist in solubilizing the resins are frequently added and these include polyol ethers such as, for example, ethylene glycol monobutyl ether (Butyl Cellosolve) and diethylene glycol monobutyl ether (Butyl Carbitol). Water solutions, dispersions and emulsions of thermosetting resins which are useful in the compositions of the present invention are available commercially from a variety of sources, and these may be further diluted or concentrated as desired.

In addition to water and resin, the coating compositions may also contain other components which modify the properties of the aqueous compositions and/or the coatings deposited on the metal articles. Thus, the aqueous compositions may contain one or more surfactants, hydrophobic fluoroalkene polymers, organic phosphate esters, pigments, organic solvents, surface tension modifiers, adhesion promoters, corrosion-inhibiting additives, flow and wetting modifiers, defoamers, etc.

The siccative organic coating compositions used in the present invention also may contain from about 0.1 to about 15% by weight based on the weight of resin, of a hydrophobic fluoroalkene polymer. The fluoroalkene polymers include polymers and copolymers of vinyl fluoride, vinylidene fluoride or tetrafluoroethylene with other polymerizable monomers. The polymers and copolymers may be prepared by suspension polymerization or by bulk polymerization. An example of a commercially available polyvinylidene fluoride is Kynar 202 available from Pennwalt Corp. An example of a polyvinyl fluoride is Tedlar available from E. I. duPont de Nemours & Co.

In one preferred embodiment, the fluoroalkene polymer is a polytetrafluoroethylene (PTFE). Polytetrafluoroethylene is available commercially from DuPont under the general trade designation "Teflon". Copolymers of tetrafluoroethylene also are useful and these include polymers of $C_2$–$F_4$ modified with small amounts of mostly fluorinated comonomus; $C_2F_4$ polymers with other fluoroolefins, etc.

In the siccative organic coating compositions used in the present invention, it is preferred that the hydrophobic fluoroalkene polymer is added to the aqueous composition in the form of particles which may be colloidal particles or solid particles. Solid polytetrafluoroethylene particles are preferred in one embodiment of the invention, and the solid particles may have average particle diameters of from about 1 to about 10 microns. Particles having an average particle size of from 1 to 5 microns are particularly preferred, and it is desirable that the particles be characterized by a controlled particle size distribution so that there are few particles of greater than 10 microns in diameter. One example of a commercially available PTFE powder useful in the present invention is Shamrock SST-4 which is available from Shamrock Technologies, Newark, New Jersey. This powder is characterized as having a 4-micron grind with essentially no particles greater than 10 microns. The incorporation of the fluoroalkene polymer, and in particular, polytetrafluoroethylene powders into the aqueous compositions of the present invention results in the formation of coatings exhibiting improved and uniform torque properties and improved corrosion-resistance. In one embodiment, the aqueous compositions will contain from 1 to about 8% by weight, based on the weight of resin (A) of the fluoroalkene polymer powders although larger or smaller amounts may be utilized in particular aqueous compositions to maximize the desired properties.

Various surfactants may be included in the aqueous coating compositions as surface tension modifiers, and these include nonionic, cationic, anionic and amphoteric surfactants which may be present in amounts of from 0.01 to about 5% by weight based on the weight of resin. These surfactants are known in the art, and many of these are described in McCutcheon's "Volume 1: Emulsifiers and Detergents", 1992, North American Edition, published by McCutcheon's Division, MC Publishing Corp, Glen Rock, N.J., and in particular, pp. 263–274 which lists a number of nonionic anionic, nonionic and amphoteric surfactants is hereby incorporated by reference for the disclosure in this regard. The surfactants may be added to the aqueous compositions directly, or the surfactant may be present in some of the other components used to form the aqueous compositions of the invention. For example, some commercial resin dispersions contain surfactants for stability. In these instances, the amount of surfactant added to the aqueous compositions can be reduced in proportion to the amount of surfactant supplied by resin dispersions used to form the aqueous compositions.

In one embodiment the aqueous organic coating compositions may contain surfactants which are acetylenic diols such as those available from Air Products under the general designation "Surfynol". Examples include Surfynol 104 which is described as 2,4,7,9-tetramethyl-5-decyn-4,7-diol (or "tetramethyl decynediol"). Solutions of this diol in various solvents are available under designations 104A, 104E, 10 4H and 104BC. Proprietary blends of acetylenic diols are available from Air Products under designations such as Surfynol GA, SE, TG and PC. Surfynol 61 is dimethyl hexynediol and Surfynol 82 is dimethyl octynediol. Ethoxylated derivatives of tetramethyl decynediol are available as Surfynol 440, 465 and 485.

In another embodiment the siccative organic coating compositions used in the present invention, particularly those containing a hydrophobic fluoroalkene polymer, may contain a small but effective amount of at least one nonionic fluorocarbon surfactant as a surface tension modifier. Generally, this amount will range from about 0.01 to about 5% by weight based on the weight of resin (A) present in the aqueous composition. Alternatively, the mount of fluorocarbon surfactant present in the dispersion may be from about 5 to about 40% by weight based on the weight of any fluoroalkene polymers present in the dispersion. Larger amounts of the fluorocarbon may be included in the aqueous coating compositions but are not generally required. In one embodiment, the amount of fluorocarbon surfactant included in the aqueous composition is an amount which is effective in stabilizing the aqueous coating composition. The fluorocarbon surfactant is surface-active and is also added to the aqueous compositions to modify the surface charge of the polymer particles in the film-forming thermosetting resin (A) and the fluorocarbon polymer particles (B). A stable dispersion is one which does not settle or is one which is easily dispersible when some sedimentation occurs.

The fluorocarbon surfactants which are particularly useful in the aqueous coating compositions of the present invention are nonionic fluorosurfactants which may be fluoro-containing compounds of the polyethylene glycol type, alkyl alkoxylates and alkyl esters. Among the preferred fluorosurfactants useful in the present invention are the fluorinated alkyl polyoxyethylene alcohols, and particularly those nonionic fluorocarbons having perfluorinated hydrocarbon chains in their structure. One type of such perfluorinated hydrocarbon chain containing surfactants comprise the fluorocarbons characterized by the following formula $$F_3C(CF_2)_mCH_2CH_2O(CH_2CH_2O)_nH \qquad (I)$$

wherein m is from about 3 to about 19 and n is from about 6 to about 19, more preferably from about 7 to about 13. In another embodiment of Formula I, m is from 5 to about 9 and n is about 11. Various surfactants characterized by Formula I will have the perfluoroalkyl and polyethylene oxide portions thereof selected to provide a satisfactory film of the surfactant on the particles of the dispersion. The fluorocarbon surfactants are either liquid or are sufficiently soluble, emulsifiable or dispersible in water.

In lieu of the perfluoroalkyl moiety of the surfactants of Formula I, the fluorosurfactants may contain partially fluorinated hydrocarbon moieties or a fluorochloro or fluorobromo moiety. Generally, however, it is preferred that the hydrocarbyl or other aliphatic lipophilic portion of this surfactant should have at least half of the hydrogen which could be present on the carbon atoms thereof replaced by fluorine atoms. Such surfactants can be made by ethoxylation of the corresponding fluorinated alkanol, e.g., perfluoroalkylethanol. Fluorocarbon surfactants useful in the present invention which are fluorinated alkyl-based polyoxyethylene alcohols are available commercially such as from DuPont under the general trade designation "Zonyl FSN" and from the 3M Company under the general trade designation "Fluorad". In particular, Zonyl FSN is believed to be a perfluorinated surfactant represented by Formula I wherein m is from 5 to 9 and n is about 11. Specific nonionic fluorocarbon surfactants which are available from DuPont include FSN, FSN-100, FSO and FSO-100. A specific example of a fluorinated alkyl-based polyoxyethylene alcohol available from the 3M Company is Fluorad FC 170C.

In lieu of the ether-type fluorocarbon surfactants described above, the aqueous coating compositions of the present invention may contain other nonionic analogues such as esters which can be made, for example, by polyethoxylation of the corresponding perfluoroalkylated lower carboxylic acid. Such surfactants are available from the 3M Company under the designations Fluorad FC-430, FC-431 and FC-740. A fluorinated alkyl alkoxylate surfactant also is available from 3M under the designation Fluorad FC-171.

Another useful surface tension modifier is a product available from Daniel Products under the trade designation DAPRO W-77. This product contains a mixture of anionic and nonionic surfactants, 2-butoxyethanol and water.

The aqueous coating compositions may also contain defoamers to control the foaming tendencies of the compositions. The choice of defoamer is not critical. Examples of organic solvents which are effective defoamers include xylene, mesitylene, benzene, aromatic petroleum spirits, methyl isobutyl ketone, and mixtures thereof. Mineral spirits added in small amounts to the aqueous compositions is an example of an effective defoamer.

In addition to the above components, the coating compositions used in the present invention may contain from about 0.01 to about 5% by weight based on the total weight of the coating composition, of an organic phosphate ester. The inclusion of an organic phosphate ester compound in the coating compositions provides the coating composition with improved corrosion resistance. The organic phosphate ester useful in the coating compositions may comprise the product of the reaction of: a copolymer of allyl alcohol and a styrene; an epoxy aryl ether; and a phosphoric acid. In one embodiment, the organic phosphate ester will comprise the reaction product of about one part of a copolymer of allyl alcohol and a styrene, from about 0.05 to about 5 parts of an epoxy aryl ether and from about 0.1 to about 2 parts of phosphoric acid. The reaction may be conveniently conducted by heating the three components, usually in an organic solvent which may be either a volatile or non-volatile solvent. Examples of volatile solvents included methyl, isobutyl, ketone, isobutyl alcohol, ethyl acetate, etc. An example of a relatively non-volatile solvent is butyl Cellosolve.

The copolymer of allyl alcohol and a styrene preferably is a low molecular weight copolymer prepared from an approximately equimolar mixture of the two monomers. The molecular weight of the copolymer is preferably within the range of from about 500 to about 2500. The styrene monomer may be styrene itself or it may be any of the various substituted styrenes such as monochlorostyrene, alkyl-substituted styrene and alpha-substituted styrene in which the alpha substituent is preferably an alkyl group such as a methyl group. Alkyl-substituted styrenes include 3-methyl styrene, 4-methyl styrene, 3-ethyl styrene, etc. Styrene is the preferred monomer.

The epoxy aryl ethers are compounds which contain both epoxy groups and aryl ether groups, and they are prepared conveniently by the reaction of epichlorohydrin with phenolic compounds. Accordingly, in one embodiment, the epoxy aryl ethers may be epoxy resins of the type identified above as examples of the film-forming thermosetting resins (A) useful in the aqueous coating compositions of the present invention although the epoxy aryl ethers useful in preparing the organic phosphate esters are generally low molecular weight resins such as those having molecular weights of from about 500 to about 2000, although resins having higher molecular weights are also useful.

Generally, for the purposes of this invention, the epoxy aryl ethers are prepared by reacting epichlorohydrin with hisphenol A (di-hydroxyphenyl dimethylomethane), or a phenol formaldehyde resin, or other such aldehyde-phenol resins. Commercially available epoxy resins prepared from bis-phenol A include the Epon resins marketed by Shell Chemical Company; the Epotuf resins marketed by the Reichhold Chemical Company; and the D.E.R. resins marketed by the Dow Chemical Company. Phenol-formaldehyde-type resins are available from Dow under the designation D.E.N. resins.

Other phenols may be used including polyhydric phenols. Examples of such phenols are resorcinol, hydroquinone, catechol and analogous polyhydric anthracines and naphthalenes. In addition to epichlorohydrin which is preferred, various other halohydrins may be used such as epibromohydrin, and the epihalohydrins of mannitol, sorbitol and aerythritol.

The preferred epoxy aryl ethers used in the reaction to form the organic phosphate esters are those which contain on the average more than one epoxy group and more than one aryl ether group per molecule. A specific example of such a resin is Epotuf 38-501 which is derived from bis-phenol (A) and characterized as having two epoxy groups, two his-phenol-derived groups per molecule. The product an epoxy equivalent weight of from 450 to 525 and a molecular weight of about 908.

The phosphoric acid reactant is preferably 85% aqueous phosphoric acid. More concentrated phosphoric acid solutions can be used, and in some instances, 100% phosphoric acid or even a more concentrated form of phosphorus pentoxide can be used. In some instances, it may desirable to use less concentrated phosphoric acid solutions such as for example 60% phosphoric acid or even 25% phosphoric acid.

The organic phosphate esters can be prepared by reacting the above components at an elevated temperature generally in the presence of a solvent. Temperatures up to the reflux temperature of the reaction mixture can be utilized and the reaction generally is completed in a period of from 0.5 to about 5 to 10 hours. Any water which is formed during the reaction may be removed from the reaction mixture as an azeotrope.

The following examples illustrate the preparation of these organic phosphate esters. Additional examples and description of such phosphate esters and methods of preparing them are found in U.S. Pat. No. 3,133,898. The disclosure of this patent is incorporated herein by reference. Unless otherwise indicated in the following examples and elsewhere in the specification and claims, all parts and percentages are by weight, temperatures are in degrees Centigrade and pressures are at or near atmospheric pressure.

EXAMPLE A

A mixture containing 29 parts of butyl Cellosolve, 11.5 parts of 85% phosphoric acid, 30 parts of Epotuf 98-501 and 29.2 parts of an allyl alcohol:styrene copolymer available from Monsanto under the designation RJ-101 is prepared and heated at the reflux temperature for 5 hours.

EXAMPLE B

A solution of 54 parts of a copolymer of equimolar proportions of allyl alcohol and styrene (molecular weight=1100) in 54 parts of methyl isobutyl ketone is added to a solution of 41.4 parts of an epoxy aryl ether (molecular weight=950) prepared by the reaction of his-phenol (A) and epichlorohydrin, in 14 grams of a 2:1 mixture of methyl isobutyl ketone and xylene. To this resulting solution there are added 336 parts of a 2:1:1 mixture of methyl isobutyl ketone, ethyl acetate and isobutyl alcohol followed by the addition of 100 parts of 85% aqueous phosphoric acid. This mixture is heated at the reflux temperature for about 5 hours and cooled. The contents of the reactor is recovered as reaction product.

The organic phosphate esters which may be utilized in the aqueous coating compositions of the present invention may also comprise the reaction product of a copolymer of allyl alcohol and a styrene, an alkyl phenol, and phosphorus pentoxide. Some of these types of phosphate esters are described in U.S. Pat. No. 3,055,865. The disclosure of this patent is incorporated herein for its description of such esters and the method of preparing them. Generally such phosphate esters can be prepared by mixing one mole of phosphorus pentoxide from about 0.2 to about 12.5 moles of a copolymer of allyl alcohol in a styrene and from about 0.3 to about 5 moles of an alkyl phenol, and heating said mixture at a temperature within the range of from about 75° C. to about 150° C.

The copolymers of allyl alcohol and a styrene useful in this embodiment may be any of the copolymers of allyl alcohol and styrene described above. Generally, the molecular weight of the copolymer used in this embodiment should be within the range of from about 750 to about 1500.

The alkyl phenol reactant may be either a mono-alkyl or a poly-alkyl phenol. The alkyl group may range from methyl groups up to alkyl groups derived from olefin polymers having molecular weights as high as 50,000. Preferably, the alkyl phenol is a mono-alkyl phenol in which the alkyl group contains from 1 to about 10 carbon atoms such as cresol, amyl phenol, heptyl phenol, nonyl phenol, etc.

The organic phosphate esters are produced in accordance with this embodiment by mixing the specified reactions, preferably in a solvent, and heating the resulting solution at a temperature within the range of from about 75° C. to 150° C. until the reaction is complete. The following example illustrates the preparation of such an organic phosphate ester.

EXAMPLE C

A mixture of 1412 parts (1.2 moles) of a 1:1 molar copolymer of allyl alcohol and styrene having an average molecular weight of about 1100, 168 parts (1 mole) of tert-amyl phenol, 68 parts (0.5 mole) of phosphorus pentoxide and 1648 parts of xylene is prepared at room temperature and then heated at reflux (about 141° C.) for 6 hours. The reaction mixture is stirred throughout this period, and at the end of this period, the xylene is removed by distillation to yield a plastic, non-viscous mass which is diluted with a solvent such as isobutyl alcohol.

The siccative organic coating compositions used in the present invention may also contain pigments which may be inorganic pigments or dyes. The choice of pigment will depend upon the particular color or colors desired in the coatings. The amount of pigment incorporated into the aqueous compositions of the present invention will be from about 0 to about 25% by weight or more of the total weight of the composition.

Carbon blacks are well-known color pigments often utilized in black formulations. Among the carbon blacks which may be utilized as color pigments in the present invention are furnace blacks, channel blacks and lamp blacks. The pigment powder also may be metal powders, metal oxides and other inorganic compounds. Examples of metallic powders include nickel, nickel flakes, steel flakes, bronze powder, aluminum powder, etc. Among the metallic oxides which can be utilized as pigments are zinc oxide, aluminum oxide, magnesium oxide, silicon, talc, mica, clay, iron oxide red, iron oxide yellow, chrome oxide green and titanium oxide white. Other inorganic pigments which may be utilized to provide desired colors include zinc sulfide, cadmium sulfide, cadmium sulfo-selenide, cadmium mercury, calcium carbonate, zinc molybdate, zinc chromate, cobalt aluminate, chrome cobalt-alumina, ultra marine blue and lead carbonate. Organic pigments include Para Red, Lithol Rubine, Halio Bordeaux, Thio Indigo, Toluidine, Anthraquinone, Phthalocyanine Blue, Phthalocyanine Green, Azo, etc.

The siccative organic coating compositions used in the present invention may be prepared in concentrated form containing, for example, from 30 to 70% of solids, and these concentrated dispersions can be diluted with water to form the bath useful for electrocoating the metal substrates. The diluted baths generally will contain from about 5 to 25% by weight of solids, and in one embodiment, about 15% solids. The bath generally is maintained under constant agitation to prevent settling, and the bath is allowed to equilibrate (e.g., at least 24 hours) before coating parts.

Electrophoresis can be carried out on metal articles maintained on racks of individually hung parts, or the articles may be contained in a porous tray or in a porous barrel. A preferred procedure for electrocoating small metal parts in accordance with this invention comprises placing the parts to be treated on a porous tray or in a porous container which can be vibrated, jolted, jogged or rotated to cause the parts to move during the electrophoretic deposition process. For example, a porous container can be jogged or jolted by means of an eccentric effective to lift and drop the container a given vertical distance at a given frequency. Alternatively, the parts can be placed in a rotatable, porous barrel, and the barrel of parts can be processed through the selective steps of cleaning, phosphating, and an optional chromic rinse. The barrel containing the phosphated parts may then be immersed in the electrocoat resin system either after drying the parts or while still wet.

In one embodiment the barrel of parts is rotated intermittently for five minutes at about 25–30° C. and at a voltage of from about 25 to about 350 volts. The number of rotation cycles employed may be varied depending upon the type and quantity of parts in the barrel. The amperage drawn is a function of the area of the barrel but it is typically from 1 to about 5 amps per square foot. The parts may then be removed from the barrel (or other porous container).

Generally the barrel is fabricated of 316 SS so that it may be employed throughout the coating cycle including the phosphate treatment and painting process. The sides of the barrel should be of $\frac{1}{8}$ to $\frac{1}{2}$ mesh to allow proper solution flow during both phosphating and painting. Optionally the barrel may be constructed of plastic and lined with 316 SS screen to provide sufficient electrode area.

At times it may be desirable to employ additional electrodes with the barrel to improve current flow, although normally the barrel itself provides sufficient electrode area.

Aqueous compositions which can be electrophoretically deposited as the first organic film in the method of the present invention containing the various components described above can be prepared by those skilled in the art. In addition, siccative organic coating compositions which can be electrodeposited in accordance with the method of the present invention are available commercially such as a water-reducible epoxy resin pigmented black which is available from Parr, Inc.; a black cathodic paint emulsion available from The Glidden Co.; etc.

The following examples illustrate aqueous siccative organic coating compositions which may be electrodeposited on phosphated metal articles in accordance with the process of the invention. Examples 1 and 2 illustrate the preparation of aqueous coating compositions which contain in addition to water and a dispersible or emulsifiable film-forming resin, a hydrophobic fluoroalkene polymer such as PTFE and a nonionic fluorocarbon surfactant. Example 3 does not contain PTFE or a nonionic fluorocarbon surfactant.

EXAMPLE 1

A first aqueous mixture is prepared which is a grind paste comprising 7.04 parts of Epotuf 38-690 epoxy resin neutralized with 1.2 parts of dimethylethanolamine, 1.01 parts of Surfynol 104 BC which is 50% solution of 2,4,7,9-tetramethyl-5-9-decyn-4,7-diol in 2-butoxyethanol (available from Air Products), 0.51 part of a foam control agent (Drewplus L-475 from Drew Industrial Division of Ashland Chemical Company), 2.79 parts of carbon black (Raven 1250 from Columbian Carbon) and 11.81 parts of deionized water by mixing at high speed until smooth. A second mixture is prepared comprising 2 parts of polytetrafluoroethylene powder (Shamrock SST-4), 0.4 part of Zonyl FSN and 2 parts of deionized water. The second mixture is added to the grind paste and dispersed in a high-speed grinding operation (pebble mill or sand mild until a Hegman 6+ grind is achieved, and then, 6 parts of water are added to form a third mixture. A fourth mixture is prepared with a high-speed grinding operation to a Hegman 5 + grind which comprises 14.16 parts of deionized water, 7.62 parts of Vantalc 6H, a magnesium silicate pigment from R. T. Vanderbilt Company, and 0.94 part of dimethylethanolamine. To this fourth mixture is then added a mixture of 20.8 parts of Epotuf 38-690, 6.72 parts of a benzoguanamine available from American Cyanamid as Cymel 1123 and 0.58 parts of triethanolamine. The viscosity is adjusted by adding 4 parts of deionized water. The mixture is filtered through a 150 micron filter, and the filtrate is the desired aqueous composition.

EXAMPLE 2

A first aqueous mixture is prepared which is a grind paste comprising 7.04 parts of Epotuf 38-690 epoxy resin neutralized with 1.2 parts of dimethylethanolamine, 1.01 parts of Surfynol104 BC which is 50% solution of 2,4,7,9-tetramethyl-5-9-decyn-4,7-diol in 2-butoxyethanol (available from Air Products), 0.51 part of a foam control agent (Drewplus L-475 from Drew Industrial Division of Ashland Chemical Company), 2.79 parts of carbon black (Raven 1250 from Columbian Carbon) and 11.81 parts of deionized water by mixing at high speed until smooth. A second mixture is prepared comprising 2 parts of polytetrafluoroethylene powder (Shamrock SST-4), 0.4 pan of Zonyl FSN and 2 parts of deionized water. The second mixture is added to the grind paste and dispersed in a high-speed grinding operation (pebble mill or sand mill) until a Hegman 6+ grind is achieved, and then, 6 parts of water are added to form a third mixture. A fourth mixture is prepared with a high-speed grinding operation to a Hegman 5+ grind which comprises 14.16 parts of deionized water, 7.62 parts of Vantalc 6H, a magnesium silicate pigment from R. T. Vanderbilt Company, and 0.94 pan of dimethylethanolamine. To this fourth mixture is then added a mixture of 20.8 parts of Epotuf 38-690, 6.72 parts of a benzoguanamine available from American Cyanamid as Cymel 1123 and 0.58 parts of triethanolamine. A fifth mixture comprising one pan of an organic phosphate ester similar to Example A, 1 pan of butyl Cellosolve and 1 part of deionized water is prepared and is neutralized to a pH of about 7.0 with 0.1 part of triethanol amine. This fifth mixture is then added to a container containing mixtures 3 and 4. The viscosity is adjusted by adding 4 parts of deionized water. The mixture is filtered through a 150 micron filter, and the filtrate is the desired aqueous composition.

EXAMPLE 3

A first aqueous mixture is prepared which is a grind paste comprising 7.04 parts of Epotuf 38-690 epoxy resin neutralized with 1.2 parts of dimethylethanolamine, 1.01 parts of Surfynol104 BC, 0.51 part of a foam control agent (Drew L475 from Drew Industrial Division of Ashland Chemical Company), 2.79 parts of carbon black (Raven 1250 from Columbia Carbon) and 8.8 parts of deionized water by mixing at a high-speed grinding operation (Pebble Mill or Sand Mill) until the Hegman 6+ is achieved. Water (6 parts) is added to the mixture. A second mixture is prepared with a high-speed grinding operation to a Hegman 5+ grind which comprises 24.96 parts of deionized water, 0.94 parts of dimethylethanolamine and 7.62 parts of Vantalc 6H, a magnesium silicate pigment from R. T. Vanderbilt Company. To the second mixture there is added a mixture of 28.48 parts of Epotuf 38-690, 6.27 parts of benzoguanamine available from American Cyanamid as Cymel 1123, and 0.58 part of triethanolamine. This second mixture is then combined with the first mixture, and the viscosity is adjusted by adding 2.18 parts of deionized water. The mixture is filtered through a 150 micron filter, and the filtrate is the desired aqueous composition.

Second Film: Seal Coat

After the phosphated metal parts have been coated with a first film of a siccative organic coating composition by electrophoresis, a second film is applied to the coated metal article by contacting the coated metal article with a composition comprising at least one film-forming organic resin component as a seal coat. In contrast to the first coating which is applied electrophoretically, the seal coat is not applied electrophoretically, but may be applied by any other technique known to those skilled in the art including immersion, flooding, spraying, etc. It is critical to the process of the present invention that this seal coat is applied to the electrophoretically coated metal articles prior to curing of the electrophoretically deposited coating. The electrophoretically deposited coating may be rinsed with water to remove impurities prior to the application of the film of the seal coat.

The compositions utilized to deposit the seal coat may comprise any of the water-dispersible or emulsifiable film-forming organic resin component described above and which can be deposited on the metal article electrophoretically. Although the coating composition utilized as the seal coat is generally different from the coating composition which is electrophoretically deposited on the metal substrate, the two films may be substantially identical. However, it is critical that the coating be applied in two steps, that the first step involve the use of electrophoretic deposition techniques, and that the second step not involve electrophoretic deposition. Also, as noted above, the deposited coatings are not subjected to elevated temperatures for baking and/or curing until both films have been deposited on the metal article.

The compositions used to deposit a second film as a seal coat may comprise any of the resins described above dissolved in an organic solvent or dispersed or emulsified in water. Because of environmental considerations, the aqueous compositions are preferred. The concentration of the resin(s) in the organic solvent or water may range from about 3% to about 40% by weight, and the compositions may contain any of the other additives described as useful in the siccative organic coating compositions.

The following Examples 4–9 illustrate aqueous coating compositions which can be used to deposit the second film which forms the seal coat.

| Components | | | Amount (pbw) |
|---|---|---|---|
| | Example 4 | | |
| Kelsol 3907[1] | | | 15.80 |
| Cymel 303 | | | 3.00 |
| Dimethylethanolamine | | | 0.50 |
| Silane A-1106 | | | 0.20 |
| Dapro W-77 | | | 0.20 |
| Mineral spirits | | | 0.30 |
| Water | | | 41.00 |
| | Reduction | | |
| Water | | | 39.00 |
| | Nominal Solids: | 15.15% w<br>13.60% v | |
| | Example 5 | | |
| Cargill 7289[1] | | | 16.00 |
| Cymel 303 | | | 3.00 |
| Dimethyloethanolamine | | | 0.50 |
| Dapro W-77 | | | 0.20 |
| Mineral spirits | | | 0.30 |
| Water | | | 41.00 |
| | Reduction | | |
| Water | | | 39.00 |
| | Nominal Solids: | 14.94% w<br>12.76% v | |
| | Example 6 | | |
| Resin XC-4005[3] | | | 15.80 |
| Cymel 303 | | | 3.00 |
| Dimethylethanolamine | | | 0.50 |
| Silane A-1106 | | | 0.20 |
| Dapro W-77 | | | 0.20 |
| Mineral spirits | | | 0.30 |
| Water | | | 41.00 |
| | Reduction | | |
| Water | | | 39.00 |
| | Nominal Solids: | 15.15% w<br>13.67% v | |
| | Example 7 | | |
| Methylon 75108[4] | | | 20.00 |
| Butyl cellosolve | | | 10.00 |
| Dapro W-77 | | | 0.60 |
| Mineral spirits | | | 0.40 |
| Water | | | 69.00 |
| | Nominal Solids: | 20.30% w<br>17.65% v | |
| | Example 8 | | |
| Haloflex 307[5] | | | 25.0 |
| 28° Aqueous ammonia | | | 0.60 |
| Butyl cellosolve | | | 2.00 |
| Foamaster S | | | 0.40 |
| Water | | | 72.00 |
| | Nominal Solids: | 15.86% w<br>10.59% v | |

-continued

| Components | | | Amount (pbw) |
|---|---|---|---|
| | Example 9 | | |
| Resin K 5276[6] | | | 23.80 |
| $H_3PO_4$ (75%) | | | 0.15 |
| Lactic acid (88%) | | | 0.80 |
| Dapro W-77 | | | 0.60 |
| Mineral spirits | | | 0.30 |
| Water | | | 74.35 |
| | Nominal Solids: | 15.80% w<br>13.50% v | |

[1]Water reducible alkyd from Reichhold.
[2]Water-reducible polyester from Cargill.
[3]Water-reducible acrylic from American Cyanamid.
[4]Water-reducible phenolic from Oxychem.
[5]Resin emulsion from ICI Resins.
[6]Water-reducible epoxy from Glidden.

The multi-layer film coatings which are deposited as described above on metal substrates generally are baked at temperatures sufficient to caused cross-linking of the thermosetting resin(s) and to produce a protective finish. Usually, temperatures of from about 90° C. to about 600° C. may be utilized, but more generally temperatures of from about 120° C. to about 200° C. are satisfactory. Curing times of from 1 to 60 minutes may be used, the longer periods of time being used when lower baking temperatures are used. The coatings deposited in accordance with the present invention exhibit good adhesion to the metal parts.

The following examples illustrate embodiments of the above process, the products of this invention, and the advantages obtained from the process. Heat treated, M10×50 hex head fasteners are placed in a stainless steel barrel which is immersed in the zinc phosphate solution typically is prepared by dissolving 33.91 grams of 75% phosphoric acid, 18.03 grams of 42° Baume nitric acid, 14.11 grams of zinc oxide and 8.81 grams of zinc chloride in 25.06 grams of water. The solution thus obtained is dissolved in water at 2–5% by volume to produce the workable phosphate bath. The fasteners are immersed for about 15 minutes at about 80° C., rinsed in water at room temperature and immersed in a chromic acid solution containing hexavalent chromium for about one minute at about 82° C.

After drying the chrome rinsed parts, the barrel is immersed in a stainless steel paint tank containing the aqueous siccative organic coating composition identified in Table I. The barrel has a power connection to the positive side of a rectifier and insulated cathodes are submerged in the tank around the barrel. The barrel is rotated intermittently and 250 volts are applied for 60 seconds. The basket is removed from the bath, shaken by hand, and re-immersed in the bath. This procedure is repeated until a total of 300 seconds of applied voltage is attained. The parts are removed from the paint tank and water rinsed. Some of the rinsed metal pieces are then immersed for one minute in an aqueous seal coat bath identified in Table I to deposit a second film on the metal pieces. The pieces are then transferred to a tray and cured for 15 minutes in an oven maintained at the temperature listed in Table I. In the "Control" examples, the fasteners did not receive a second film of seal coat.

It has been found that when small metal parts such as M10×50 hex head fasteners are treated in accordance with the procedure of the invention, improved rust-inhibition is observed. The improvement is demonstrated when control and treated test pieces are subjected to a Salt Fog Corrosion Test (ASTM Procedure designation B 117-57T). In this test, the coated parts are suspended in a salt fog cabinet, and a 5% sodium chloride solution is sprayed onto the parts at about 38° C. for a period of up to about 288 hours or more, and the parts are examined every 24 hours for the appearance of rust, primarily pinpoint rust. Tests were conducted on ten fasteners coated as described above and on ten control fasteners. The coated parts are aged 24 hours before they are subjected to the salt spray test. The results are summarized in Table I.

TABLE I

| Example | First Film of Example | Second Film of Example | Curing Temp (°F.) | Salt Fog Test Results (Significant rust after) |
|---|---|---|---|---|
| Control I | 3 | none | 350 | 48 hrs. |
| I | 3 | 4 | 350 | 144 hrs. |
| II | 3 | 9 | 375 | 288 hrs. |
| Control III | * | none | 350 | 24 hrs. |
| III | * | 4 | 350 | 216 hrs. |

*In these examples, the electrodeposited first film is a film of a cathodic epoxy electrocoat available from The Glidden Company.

The results which are summarized in the above table demonstrate the improved corrosion resistance obtained when the fasteners are treated in accordance with the present invention. The presence of the seal coat film dramatically improves the corrosion resistance when compared to the fasteners having only the electro-deposited film.

Top Seal Coat

Although the metal parts which have been phosphated, electrocoated with a first film of a siccative organic coating, and coated with a second film of seal coat prior to baking in the manner described above exhibit improved resistance to corrosion, it has been found that the inhibition of corrosion of the metal parts can be further increased by applying a corrosion inhibiting film a top seal coating. The top seal coat may comprise oil, oil containing a corrosion inhibitor, or a synhthetic corrosion inhibitor without oil.

The top seal coating can be of a straight undiluted oil such as any oil which is liquid or soluble in a solvent under the conditions of application. Examples of such oils include kerosene, fuel oil, gas oil, synthetic oils such as dioctyl adipate and dinonyl sebacate and naturally occurring oils such as castor oil, olive oil, sesame seed oil or mineral oils. Mineral oils are preferred because of their low cost and availability. Generally the oils will be fluid oils ranging in viscosity from about 40 Saybolt Universal seconds at 38° C. to about 200 Saybolt seconds at about 100° C.

The oils may be mixed with organic solvents including those used in the paint and lacquer industries, such as xylene, mesitylene, benzene, aromatic petroleum spirits, lauryl alcohol, dianyl naphthalene, dicapryl diphenyl oxide, didodecyl benzene, methyl isobutyl ketone and chlorinated alkanes such as ethylene dichloride and 1,2-dichloropropene. Mixtures of these solvents are useful. On drying the seal coating, the more volatile solvents evaporate and leave a seal coating of oil as a rust-inhibiting film.

The oil top seal coating can be applied as an emulsified water:oil mixture containing wetting or surface-active agents followed by drying to remove the water. One advantage of the water:oil mixtures is that no hazardous organic solvents are involved in the process.

The oil which is applied as the top seal coat also may contain other compositions which improve the rust-inhibiting properties of the oil. Compositions which are known in the art as corrosion inhibitors may be included in the oil to be applied as the seal coat, generally in amounts up to about 20–25% or higher. Various corrosion inhibitors can be included in the oil or applied neat to the metal article. Examples of corrosion inhibitors include dibasic acids neutralized with amines or hydroxyamines. Examples of dibasic acids include adipic acid, succinic acid, sebacic acid, glutaric acid, malonic acid, suberic acid, etc. Examples of amines include methyamine, ethylamine, ethanolamine, diethanolamine, triethanolamine, etc. The oils may also contain emulsifiers such as phosphate esters and neutralized tall oil fatty acids. The corrosion inhibitor may also be applied without oil as a top seal coat. An example of a useful composition is a mixture of borate amines, neutralized fatty acids and oxygenated hydrocarbons.

Another example of useful additive compositions are metal-containing phosphate complexes such as can be prepared by the reaction of (a) a polyvalent metal salt of the acid phosphate esters derived from the reaction of phosphorus pentoxide with a mixture of monohydric alcohol and from about 0.25 to 4.0 equivalents of a polyhydric alcohol, with (b) at least about 0.1 equivalent of an organic epoxide. Thin films of these complexes in oil over the phosphated and painted metal parts are effective in inhibiting the corrosion of the metal surfaces.

These types of metal-containing phosphate complexes which are contemplated as being useful in the process of the invention are described in U.S. Pat. No. 3,215,715, and the disclosure of the patent is hereby incorporated by reference.

In general, the acid phosphate esters required for the preparation of starting material (a) are obtained by the reaction of phosphorus pentoxide with a mixture of a monohydric alcohol and a polyhydric alcohol. The precise nature of the reaction is not entirely clear, but is known that a mixture of phosphate esters is formed.

The monohydric alcohols useful in the preparation of starting materials (a) are principally the non-benzenoid alcohols, that is, the aliphatic and cycloaliphatic alcohols, although in some instances aromatic and/or heterocyclic substituents may be present. Suitable monohydric alcohols include propyl, isopropyl, butyl, amyl, hexyl, cyclohexyl, methylcyclohexyl, octyl, tridecyl, benzyl and oleyl alcohols. Mixtures of such alcohols also can be used if desired. Substituents such as chloro, bromo, nitro, nitroso, ester, ether, keto, etc., which do not prevent the desired reaction also may be present in the alcohol. In most instances, however, the monohydric alcohol will be unsubstituted alkanol.

The polyhydric alcohols useful in the preparation of starting materials (a) are principally glycols, i.e., dihydric alcohols, although trihydric, tetrahydric and higher polyhydric alcohols may be used. In some instances, they may contain aromatic and/or heterocyclic substituents as well as other substituents such as chloro, bromo, nitro, ether, ester, keto, etc. Examples of suitable polyhydric alcohols include ethylene glycol, diethylene glycol, triethylene glycol, propylene glycol, 1,3-butanediol, glycerol, glycerol monooleate, mono-benzylether of glycerol, pentaerythritol and sorbitol dioctanoate. Mixtures of these polyhydric alcohols can be used.

The reaction between the alcohol mixture and the phosphorus pentoxide is exothermic and can be carded out conveniently at a temperature ranging from room temperature or below to a temperature just below the decomposition point of the mixture. Generally temperatures within a range of from about 40° C. to about 200° C. are satisfactory. The reaction time varies according to the temperature and to the reactivity of the alcohols. At higher temperatures as little as 5 or 10 minutes may be sufficient for complete reaction, while at room temperature, 12 or more hours may be required.

The reaction may be conducted in the presence of an inert solvent to facilitate mixing and handling. Typical solvents include petroleum aromatic spirits boiling in the range of 120°-200° C., benzene, xylene, toluene, and ethylene dichloride. In most instances, the solvent is allowed to remain in the acid phosphate esters and ultimately in the final metal-containing organic phosphate complex which serves as a vehicle for the convenient application of films to the painted articles.

The conversion of the acid phosphate esters to the polyvalent metal salt can be carded out by any of the usual methods for preparing salts of organic acids. The polyvalent metal of starting material (a) may be any light or heavy polyvalent metal such as zinc, cadmium, lead, iron, cobalt, nickel, barium, calcium, strontium, magnesium, copper, bismuth, tin, chromium, or manganese. The polyvalent metals of Group II of the Periodic Table generally are preferred. One example of a highly effective starting material (a) is the zinc salt of the acid phosphate esters formed by the reaction of a mixture of equivalent amounts of isooctyl alcohol and dipropylene glycol with phosphorus pentoxide.

As mentioned above, the complex is obtained by reacting the polyvalent metal salts (a) with Co) an organic epoxide. Organic epoxides containing at least one $$-C-C_x-C-O$$

linkage where x is zero or a small integer, suitable for the purpose of this invention include the various substituted and unsubstituted alkylene oxides containing at least two aliphatic carbon atoms, such as, e.g., ethylene oxide, 1,2-propylene oxide, 1,3-propylene oxide, 1,2-butylene oxide, pentamethylene oxide, hexamethylene oxide, 1,2-octylene oxide, cyclohexene oxide, styrene oxide, alpha-methyl styrene oxide, beta-propiolactone, methyl epoxycaprylate, ethyl epoxypalmitate, and epoxidized soybean oil. Of the various available organic epoxides, it is preferred to use those which contain at least 12 carbon atoms. Especially preferred are those epoxides which contain at least 12 carbon atoms and also a carboxylic ester group in the molecule. Thus, the commercially available epoxidized carboxylic ester, butyl epoxystearate, is very satisfactory as starting material (b) for the purpose of this invention. If desired, the organic epoxide may also contain substituents such as chloro, bromo, fluoro, nitro, nitroso, ether, sulfide and keto, in the molecule.

Complexes prepared using as little as 0.1 or 0.25 equivalent or as much as 1.5 or 2 or more equivalents of the organic epoxide per equivalent of polyvalent metal salt are satisfactory for the purpose of this invention. For reasons of economy and optimum corrosion inhibition, however, it is generally preferred to use about equivalent amounts of the two starting materials.

The reaction between the organic epoxide and the polyvalent metal salt of the acid phosphate esters is only slightly exothermic, so in order to insure complete reaction some heat generally is supplied to the reaction mass. The time and temperature for this reaction are not particularly critical; satisfactory results may be obtained by maintaining the mass for 0.5-6 hours at a temperature within the range of from about 40° C. to about 150° C. Ordinarily the product is clear and does not require filtration. In some instances, however, it may be desirable to filter the product, particularly when the polyvalent metal salt starting material has not been purified.

The following examples illustrate some of the types of metal-containing organic phosphate complexes which can be incorporated into the top seal coat in accordance with the procedures described above.

EXAMPLE D

Forty-nine parts (0.73 equivalent) of dipropylene glycol, 95 parts (0.73 equivalent) of isooctyl alcohol, and 133 parts of aromatic petroleum spirits boiling in the range of 316°-349° F. are introduced into a reaction vessel. The whole is stirred at room temperature and 60 parts (0.42 mole) of phosphorus pentoxide is introduced portionwise over a period of about 0.5 hour. The heat of reaction causes the temperature to rise to about 80° C. After all of the phosphorus pentoxide has been added, the whole is stirred for an additional 0.5 hour at 93° C. The resulting acid phosphate esters show an acid number of 91 with bromophenol blue as an indicator.

The mixture of acid phosphate esters is converted to the corresponding zinc salt by reacting it with 34.5 parts of zinc oxide for 2.5 hours at 93° C. Thereafter 356 parts (one equivalent per equivalent of zinc salt) of butyl epoxy stearate is added to the zinc salt at 88° C. over a period of about one hour and the whole is stirred for 4 hours at 90° C. Filtration of the mass yields 684 parts of a zinc-containing organic phosphate complex having the following analysis:

| | |
|---|---|
| % Phosphorus | 3.55 |
| % Zinc | 3.78 |
| Specific gravity | 1.009 |

EXAMPLE E

A cadmium-containing organic phosphate complex is made in the manner set forth in Example D, except that 54.5 parts of cadmium oxide is used in lieu of the specified amount of zinc oxide.

EXAMPLE F

Five-hundred and twenty parts (4 equivalents) of isooctyl alcohol, 268 parts of dipropylene glycol (4 equivalents), and 1031 parts of toluene solvent are introduced into a reaction vessel. The whole is stirred and 243 parts (1.71 moles) of phosphorus pentoxide is added portionwise over a period of 2 hours. The exothermic character of the reaction causes the temperature to rise from room temperature to 60° C. To insure complete reaction, the whole is stirred for an additional 4 hours at 60° C. The resulting 50% solution of the acid phosphate esters in toluene shows an acid number of 88 with bromphenol blue as an indicator.

The toluene solution of acid esters (1000 parts) is converted to the corresponding zinc salt by reaction with 83 parts of zinc oxide for 5.5 hours at 40°-45° C. Filtration yields a clear, light-yellow toluene solution of the zinc salt. 360 parts of this toluene solution (containing 0.34 equivalent of zinc salt) is heated with 25 parts (0.34 equivalent) of beta-propiolactone for 5.5 hours at 50°–60° C. to yield the desired zinc-containing organic phosphate complex as a 55% solution in toluene. It has the following analysis:

| | |
|---|---|
| % Phosphorus | 4.26 |
| % Zinc | 5.05 |

EXAMPLE G

A zinc-containing organic phosphate complex is made in the manner set forth in Example D, except for the following differences: 50 parts of 1,2-propylene oxide is used in lieu of the butyl epoxystearate and the reaction between the zinc salt of the acid phosphate esters and the 1,2-propylene oxide is carried out at 30°–35° C. rather than 88°–90° C.

Examples of oils and oil:water emulsions containing a metal-containing organic phosphate complex of the type described above are as follows.

EXAMPLE 10

An oil mixture is prepared containing 60 parts of mineral oil, 2 parts of triethanolamine, 3 parts of oleic acid, 15 parts of a sodium sulfonate wetting agent and 20 parts of the product of Example D.

EXAMPLE 11

The mixture of this example comprises 65 parts of mineral oil, 2 parts of triethanolamine, 3 parts of oleic acid, 15 parts of the product of Example G and 15 parts of a sodium sulfonate wetting agent.

EXAMPLE 12

An emulsion is prepared by vigorously mixing 20 parts of the oil of Example 10 with 80 parts of water.

EXAMPLE 13

An emulsion is prepared by vigorously mixing 15 parts of the oil mixture of Example 11 with 85 parts of water.

The above-described oil top coat treatments are applied to the articles immediately after the baking operation. As a practical matter, the oil application, preferably, the water-oil emulsion or dispersion can be utilized as a quench after the baking operation.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A method of producing an adherent and corrosion-inhibiting multi-layer coating on metal parts comprising the steps of (A) phosphating the metal parts with an aqueous metal phosphating solution;

(B) electrophoretically depositing a film of a siccative organic coating composition on the phosphated metal parts contained on a rack or in a rotatable porous barrel to form a first film;

(C) non-electrophoretically applying a second film of a composition prior to curing of the coating deposited in (B) to the electrophoretically coated metal parts to form a seal coat, said second film comprising at least one film-forming organic resin component;

(D) curing the coatings on the metal parts; and (E) applying a corrosion-inhibiting film as a top seal coat on the cured coated metal parts.

2. The method of claim 1 wherein the aqueous metal phosphating solution is an aqueous acidic zinc, lead, iron or manganese phosphating solution.

3. The method of claim 1 wherein the phosphated metal part obtained in step (A) is further rinsed with water or contacted with an organic or inorganic composition or an aqueous solution containing an organic or inorganic composition which seals the phosphate coating prior to step (B).

4. The method of claim 3 wherein the phosphated metal part is rinsed with an aqueous solution containing chromium or an alkali metal fluorozirconate, and the rinsed metal is dried prior to the electrophoretic deposition of step (B).

5. The method of claim 1 wherein the electrophoretic deposition in step (B) is conducted on the phosphated metal parts contained in a rotatable porous barrel.

6. The method of claim 5 wherein the electrophoretic deposition of the organic coating is carried out at a voltage within the range of from about 50 to 1000 volts at temperatures of from about 20°–40° C. and for a period of from about 10 seconds to about 10 minutes.

7. The method of claim 1 wherein the siccative organic coating composition used in (B) is an aqueous dispersion, emulsion or solution of a thermosetting resin wherein the concentration of the resin is from about 3% to about 40% by weight.

8. The method of claim 7 wherein a pigment or dye is incorporated into said resin dispersion, emulsion or solution.

9. The method of claim 1 wherein the siccative organic coating composition used in step (B) comprises a polar resin containing at least one member selected from the group consisting of epoxy resins, melamine-formaldehyde resins, alkyd resins, polyester resins, acrylic resins and polybutadiene resins.

10. The method of claim 1 wherein the composition applied in step (C) comprises water and at least one water-dispersible or emulsifiable film-forming resin selected from urethane resins, amino resins, acrylic resins, alkyd resins, epoxy resins, phenolic resins, cyclized olefin rubbers, and mixtures thereof.

11. The method of claim 1 wherein the film applied in step (E) as a top seal coat comprises oil, oil containing a corrosion inhibitor, or a corrosion inhibitor without oil.

12. The method of claim 1 wherein the film applied in step (E) as a top seal coat comprises oil containing a corrosion inhibitor.

13. The method of claim 1 wherein the film applied in step (E) comprises mineral oil and a metal-containing organic phosphate complex prepared by the process which comprises the reaction of (a) a polyvalent metal salt of an acid phosphate esters derived from the reaction of phosphorus pentoxide with a mixture of saturated aliphatic or cycloaliphatic monohydric alcohol containing from about 3 to about 18 carbon atoms, and from about 0.25 to 4 equivalents of a polyhydric alcohol having from 2 to 4 hydroxyl groups and containing from about 2 to about 41 carbon atoms with (b) at least about 0.1 equivalent of an organic epoxide.

14. The method of claim 13 wherein the polyvalent metal salt is a zinc salt.

15. A method of producing an adherent and rust-inhibiting multilayer finish on metal parts selected from the group consisting of ferrous metal, zinc, aluminum, and alloys thereof comprising the steps of (A) immersing the parts in an aqueous acidic zinc, lead, iron or manganese phosphating solution for a period of time and at a temperature sufficient to deposit an adherent phosphate coating on said metal parts;

(B) rinsing the phosphate-coated parts with an aqueous acidic solution containing an under-paint corrosion inhibitor;

(C) immersing the phosphate-coated metal parts contained on a rack or in a rotatable porous barrel in an aqueous dispersion, emulsion or solution of a thermosetting resin and passing through said parts, an electric current thereby electrodepositing resin particles on the phosphate-coated parts by electrophoresis to form a first resin film;

(D) contacting the electrophoretically coated parts with an aqueous composition prior to curing of the coating deposited in (B) to form a second film of the aqueous composition over the first film as a seal coat, said second film comprising water and at least one water-dispersible or emulsifying film-forming resin;

(E) curing the films on the metal parts by subjecting the parts to an elevated temperature for a time sufficient to cure the films; and (F) contacting the cured resin-coated parts with oil, oil containing a corrosion inhibitor, or a corrosion inhibitor without oil to form a top seal coat.

16. The method of claim 15 wherein the parts obtained in step (C) are further rinsed with water prior to step (D).

17. The method of claim 15 wherein the metal parts are immersed in step (A) in an aqueous acidic zinc phosphating solution.

18. The method of claim 15 wherein the concentration of the thermosetting resin in the aqueous dispersion emulsion or solution used in step (C) is from about 3 to about 40% by weight.

19. The method of claim 15 wherein the film of siccative organic coating composition is electrophoretically deposited on the phosphated surface in step (C) by immersing said parts in the aqueous dispersion, emulsion or solution of thermosetting resin and passing through said metal as an anode, a direct current having an initial voltage of from about 200 to 300 volts at about 4 to about 5 amperes.

20. The method of claim 15 wherein the thermosetting resin used in step (C) is at least one water-dispersible or emulsifiable resin selected from the group consisting of epoxy resins, melamine formaldehyde resins, alkyd resins, polyester resins, acrylic resins, polybutadiene resins, cyclized olefin rubbers and phenolic resins.

21. The method of claim 15 wherein the resin films are cured in step (D) by heating at a temperature of from about 120° C. to about 250° C. for from about 5 to about 30 minutes.

22. The method of claim 15 wherein the film applied as a seal coat in step (D) comprises water and at least one thermosetting resin selected from the group consisting of epoxy resins, melamine formaldehyde resins, alkyd resins, polyester resins, acrylic resins, polybutadiene resins and phenolic resins.

23. The method of claim 22 wherein the resin is a water-dispersible or emulsifiable epoxy resin or phenolic resin.

24. The method of claim 15 wherein the aqueous dispersion, emulsion or solution of thermosetting resin used in step (C) comprises in addition to water (1) at least one water-dispersible or emulsifiable film-forming thermosetting resin;

(2) from about 0.1 to about 15% by weight, based on the weight of resin (1) of a hydrophobic fluoroalkene polymer; and (3) an effective amount of at least one nonionic fluorocarbon surfactant.

25. The method of claim 24 wherein the film-forming resin (1) comprises a mixture of an epoxy resin and an aminoplast resin.

26. The method of claim 15 wherein the metal parts are contacted with the aqueous composition in step (D) by immersion or spraying.

27. The method of claim 15 wherein the cured resin coated parts are contacted in step (F) with oil or oil containing a corrosion inhibitor.

* * * * *